United States Patent [19]

Geuss

[11] 4,116,039

[45] Sep. 26, 1978

[54] DROP HAMMER FRAME WELDMENT AND ASSEMBLY

[75] Inventor: Joseph A. Geuss, Alliance, Ohio

[73] Assignee: Amca International Corporation, Hanover, N.H.

[21] Appl. No.: 776,088

[22] Filed: Mar. 9, 1977

[51] Int. Cl.[2] ..... B21J 7/06

[52] U.S. Cl. ..... 72/455; 72/456

[58] Field of Search ..... 72/455, 456, 435, 438, 72/429, 444, 453.01

[56] References Cited

U.S. PATENT DOCUMENTS

| | | | |
|---|---|---|---|
| 442,898 | 12/1890 | Kennedy | 72/455 |
| 1,875,939 | 9/1932 | Schneider | 72/453.01 |
| 2,236,154 | 3/1941 | Patrick | 72/456 |
| 2,589,402 | 3/1952 | Kropp | 72/456 |
| 2,737,066 | 3/1956 | Riemenschneider | 72/456 |
| 3,621,703 | 11/1971 | Swift | 72/453.01 |

*Primary Examiner*—C.W. Lanham
*Assistant Examiner*—Gene P. Crosby

[57] ABSTRACT

An improved upright frame element for fluid operated drop hammers which are fabricated from low carbon steel plates, slabs and forgings welded together and forming a massive, integrated weldment of multiple boxlike fabrications having strong horizontal internal and external reinforcing structures welded to the essential upstanding parts of the frame and lending strength against the several forces and components in torsion, bending, shear and against vibration to which drop hammer frames are subjected violently in normal use. All the upstanding end members and side plates are welded to and integrated with a firm horizontal base member at their lower ends and to and with a heavy horizontal top member at their upper ends. The base and top members close the uppermost and lowermost of the several boxlike fabrications with the nearest of the several horizontal reinforcing structures mentioned above. When a pair of my improved frame elements are juxtaposed in the whole frame of a drop hammer, they coact to protect each other and preserve themselves advantageously.

18 Claims, 10 Drawing Figures

FIG.3
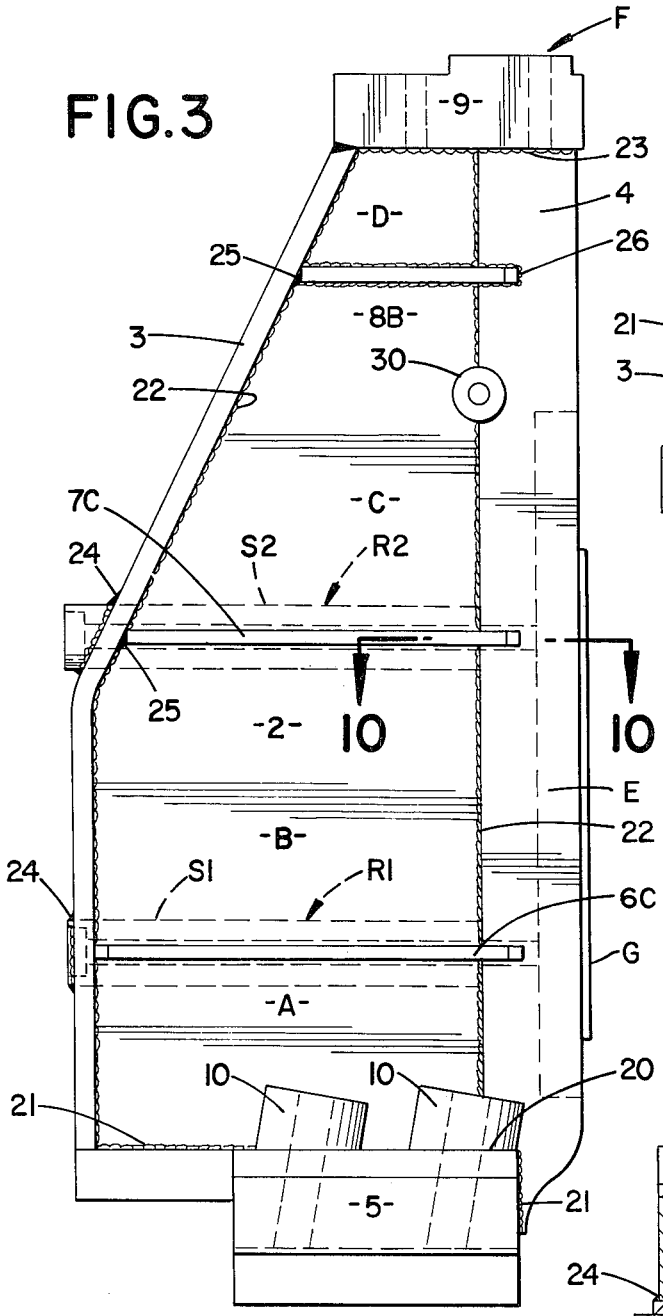
FIG.4
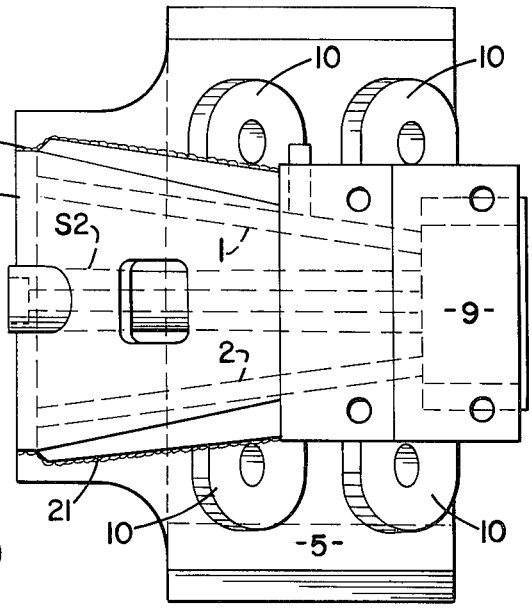
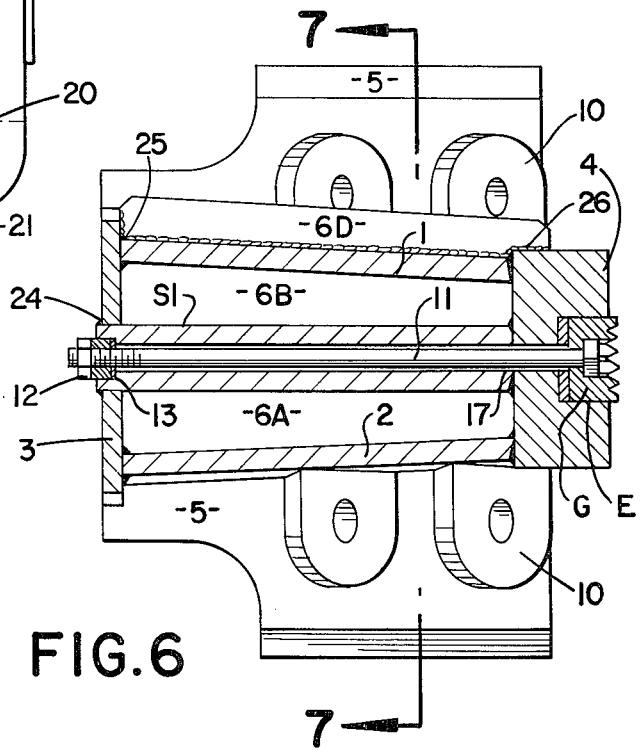
FIG.6

DROP HAMMER FRAME WELDMENT AND ASSEMBLY

BRIEF SUMMARY OF THE INVENTION

Each frame element embodying my invention comprises a series of vertically stacked box sections, integrated by being securely welded into and/or onto the frame element. The destructive forces resulting from the reaction of the work on the ram varies in magnitude, location and frequency which the frame element must resist and endure. The box section elements are so located to resist these forces and the twisting resulting when the forces are combined in the frame. The prior art cast steel frames being hollow, do not locate reinforcing material in a manner to balance and withstand these forces. Vibration and frequency of forces appear to be as destructive of frames as the magnitude of torsional, bending and shearing forces. During the operation of the drop hammer frame must withstand forces being applied totally or separately horizontally from the gib area and also upward through the base plate into the vertical plates. The vertical force is a resultant force traveling from ram to die to anvil and upward to the frame. They sometimes combine to twist, and vibrations of various frequencies are set up.

My frame element comprises the combination of a vertical upright front end member having a pocket for carrying one of the gibs for guiding the ram, an upwardly extending back end member spaced rearwardly from the front member, upwardly extending near and far side plates widely spaced from each other and engaging and spacing said front and back members and welded thereto, horizontal reinforcing sleeves engaging and welded to said end members at opposite ends of the sleeve in alignment with the vertical plane of the gib, a bolt having its head immovably secured in the gib and extending coaxially and freely throughout said sleeve with its threaded end extending beyond the end of the sleeve adjacent the backside of said back member. There are also horizontally disposed reinforcing plates closely fitted in alignment with the horizontal plane of the axis of said bolt and sleeve between opposite sides of said sleeve, said side plates and said front and back members and securely welded to each thereof and forming a monolithic slab integrated with said sleeve, side plates and front and back elements, a nut screwed on said bolt and prestressing said bolt in tension and said sleeve in compression, said prestressed bolt also tending to draw said members toward each other and tending to precompress all said plates between said members.

The frame element also has gussets aligned horizontally with said reinforcing plates and disposed outside said side plates and engaging said front and back members and securely welded to said plates and members and extending said slab outside said side plates. The frame element has a plurality of said slabs disposed in said frame and spaced vertically from each other and forming a plurality of integrated boxlike structures.

My invention also comprises a pair of said frame elements, with the gibs and front members juxtaposed and the elements joined to each other through an anvil at the bottom and a tie plate at the top.

BRIEF DESCRIPTION OF THE VIEWS OF THE DRAWINGS

FIG. 3 is a side elevation of said frame element.

FIG. 4 is a top plan view of the said frame element.

FIG. 6 is a broken sectional view taken along the broken line 6—6 of FIG. 1.

DETAILED DESCRIPTION OF THE PREFERRED FORM OF THE INVENTION

Figure 8:
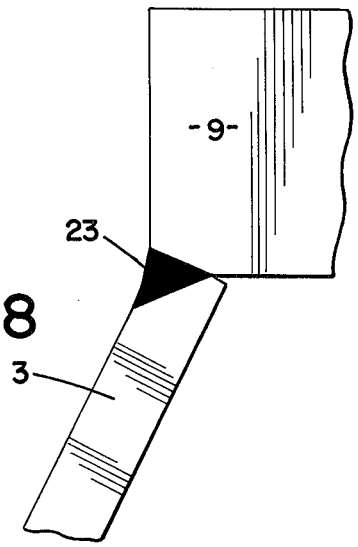
FIG. 8 is an enlarged view of a typical weld, particularly the weld between the rear plate and top plate of the said frame as shown also in FIG. 3.
Figure 9:
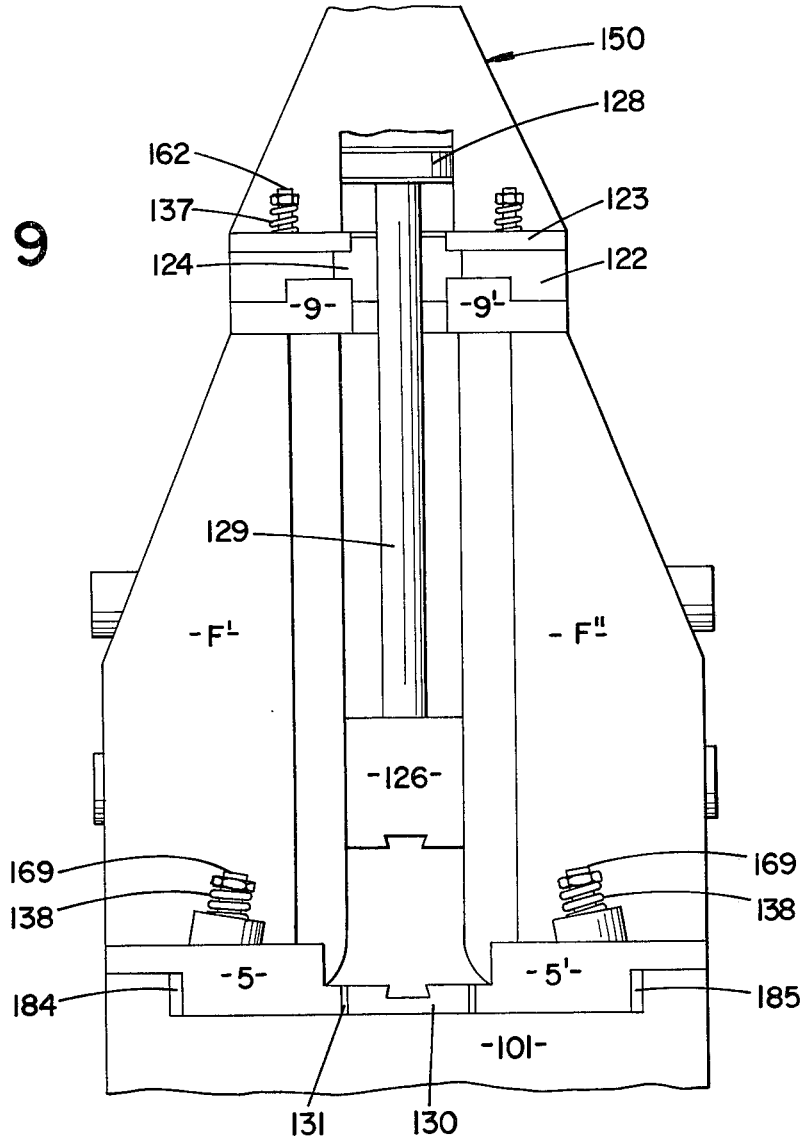
FIG. 9 is a diagrammatic sketch showing the arrangement of the essential constitutents of a drop hammer in which frame elements similar to my invention are substituted in the places for those of prior practice to suggest the environment in which my frame elements are to be used and wherein they coact with each other.

The environment for the frame elements embodying the preferred form of my invention, comprises the structure and constituents of a pneumatic or steam drop hammer as shown illustratively in FIG. 9, wherein all is old and conventional except the new and useful features of the side frame elements F′ and F″ and the coaction between a pair of such elements in a drop hammer. Such a drop hammer comprises a right frame element F″ and preferably an equal and opposite left element F′, which, as shown, may correspond superficially to the frame element F, FIGS. 1–8 and 10 inclusive, in which the preferred form of my invention is particularly embodied.

Apart from my improved frame elements F′ and F″ and the novel coaction therebetween, the drop hammers in which they may be used to advantage are essentially well known and conventional as suggested in FIG. 9, in which the great anvil 101 supports the left base 5 of and for the left frame element F′, and supports the right base 5′ of and for the right element F″. The bases 5 and 5′ rest directly on the anvil and are secured thereto by spring loaded bolts 169 with bolt springs 138. Also resting on the anvil and firmly secured between the bases 5 and 5′, is the conventional sow block 130 secured by the sow block key 131. In much the same way, the bases 5 and 5′ of the frames F′ and F″ are tightly wedged into engagement with the anvil by wedges 184 and 185.

Figure 10:
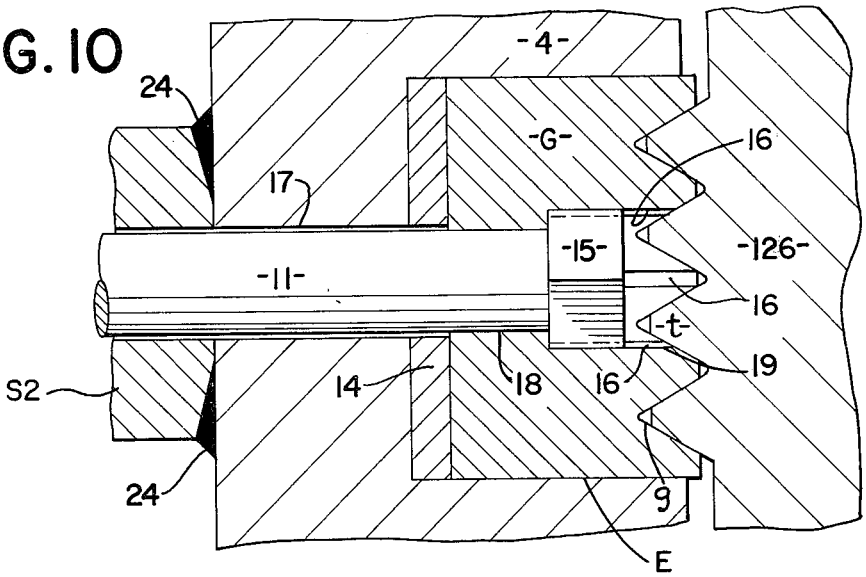
FIG. 10 is a fragmentary horizontal section on a reduced scale taken on the plane 10—10 of FIGS. 1 and 3 with the gib and wedge supplied in the gib pocket and with a fragment of the ram, FIG. 9, engaging the grooves of the gib. Part of the tie bolt in the gib and the reinforcing sleeve welded to the front end member are also shown.

The conventional ram 126 is guided by vertically extending gibs G, FIG. 10 carried in the juxtaposed front walls of the frames and engage the rightward and leftward sides of the ram as viewed and guide the ram in its vertical, upward and downward travel. As suggested, the bottom face of the ram has a dovetailed groove to carry the usual upper die, not shown, which in cooperation with a mating lower die, not shown, but carried by the sow block 130, engages the hot, plastic metal to be worked between the dies.

The ram is lifted conventionally by a piston rod 129 actuated by piston 128 moving in a conventional "cylinder" 150. The base flange 123 of the cylinder 150 rests on a conventional tie plate 122 which bridges over the heads 9 and 9' of both frames. Cylinder bolts and nuts 162 compress springs 137 to secure the cylinder and the plate to the heads of the frames with enough resilient "give" to preserve the parts in operative relation and protect them from the shocks and vibrations that are necessarily incident to drop forging.

The wedge 14 for adjustment of the gib G by which its clearance from the ram is conventional, is shown in part in FIG. 10. In the interest of brevity, the conventional valves and valve gear are omitted from FIG. 9.

Figure 1:
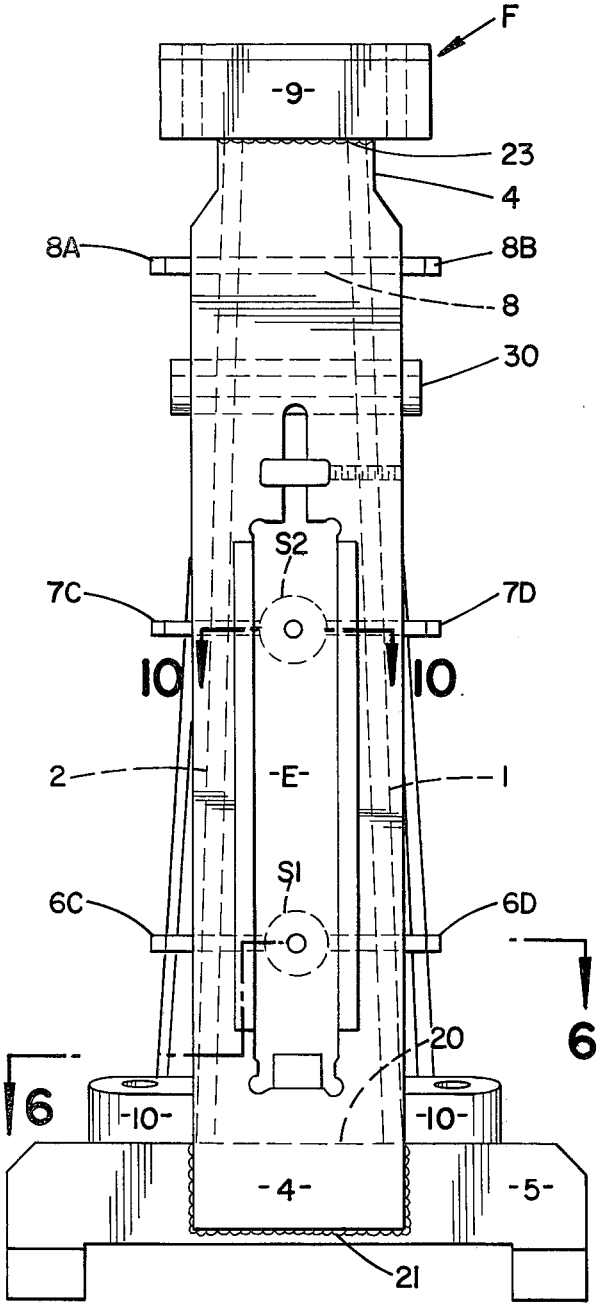
FIG. 1 is a front elevation of a drop hammer frame element embodying my invention.

The frame element F, FIGS. 1–8 and 10 departs from and improves upon the prior art in the novel features of design and construction discussed and referred to above and now more particularly illustrated and described with reference to the drawings, as follows:

In FIG. 1, the great front end member 4 is seen to rise vertically from the base 5, FIG. 3, on the forward edge 20 on which it rests and is welded and secured as suggested conventionally at 21, FIGS. 1 and 3. Both the upright far side plate 1 and the near upright side plate 2, along with the back end member 3 are welded to and integrated with the base 5 as suggested by conventional, wide, darkened lines 21 on the base 5 in FIGS. 1, 3 and 5, having regard that the substance of the typical weld which I prefer is shown in FIGS. 3 and 8.

The front and rear edges of the near and far side plates 2 and 1 are welded to and integrated with the rear of the front end member 4 and front of the back end member 3 as at 22, FIGS. 1, 2, 3, 4 and 5, the upper ends of the end members and side plates are welded to and integrated with the underside of the top member or head 9 as at 23.

The frame F has, as suggested above, horizontal monolithic reinforcing structural slabs, R1, R2, and 8, 8A and 8B which, taken with the base 5 at the bottom and the head 9 at the top, provide four closed boxlike parts A, B, C and D. FIGS. 1, 2, 3, 4, 5, 6, 7 and 10. The two lower reinforcing slabs R1 and R2 are substantially the same; each embracing a stout cylindrical sleeve, S1 and S2, and coaxial tie bolts 11 whose axes lie in the vertical median plane of the frame between the side plates 1 and 2 as viewed in FIGS. 1, 2 and 7.

Figure 2:
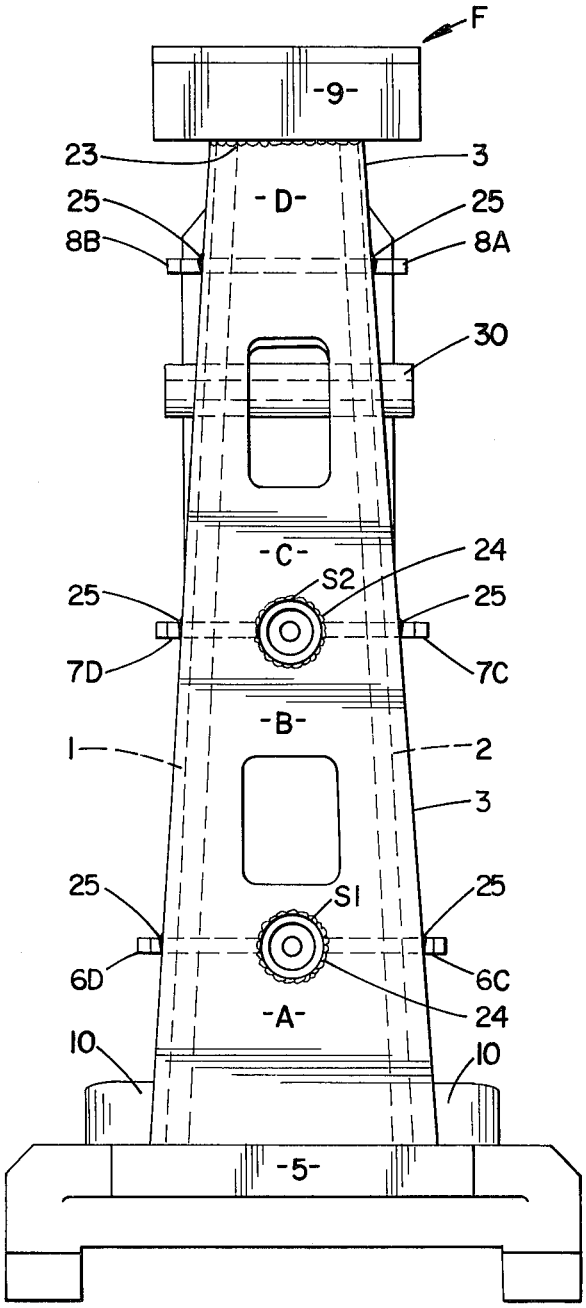
FIG. 2 is a rear elevation of the said frame element.

The slab R1 also comprises constituent horizontal plates 6A, B, C and D, while the slab R2 is slightly smaller, see FIG. 2, and comprises corresponding horizontal plates 7, A, B, C and D, all secured together and to the sleeves S1 and S2 and to the upright members 3 and 4 and to the near and far side plates in the same way. Slab R1 only, need be described in detail with reference to the drawings.

As best shown in FIGS. 6 and 10, the sleeve S1, whose outside diameter is nearly as great as the width of the gib pocket E, in the front end member 4, is welded as at 24 to the back side of that member and also, conveniently, to the exposed back side of the back end member, FIGS. 2 and 3. Tie bolt 11 extends coaxially through the whole length of the sleeve with preferably significant clearance such as 1/16 inch between the inside diameter of the sleeve and the outside diameter of the bolt. Such clearance inhibits the transmission of vibration between the sleeve and the bolt.

Tie bolt 11 passes through hole 17 in the rear part of the front end member 4 and through hole 18 in the gib with a close sliding fit through hole 18 only; the bolt having entered those holes via counterbore 19 in the gib where the squared head 15 of the bolt is anchored and held against rotation as by the corners of the bolt engaging longitudinally hobbed grooves 16 in the counterbore. FIGS. 6 & 10. The threaded far end of bolt 11 receives nut 12; the inner end of which enters the counterbore at the far end of the sleeve, and engages lock washer 13 in as firm a removable shake-proof engagement as is practicable to provide. Spherical spring lock washers capable of exerting great axial thrust when nearly flattened between the nut and bottom of the counterbore are preferred to hold the threads of the nut and bolt in tight contact highly resistant to involuntary relative movement.

The head 15 of bolt 11 lies below, leftward as viewed in FIG. 10, the roots of the grooves g in the gib and safely clear of interference with the straight teeth t formed in the side of the ram 126. It is an advantage of my invention that the strength and firmness of my frame F permits the clearance between the teeth and grooves of the gibs and ram to be reduced appreciably compared with accepted prior practice. This guides the ram more accurately and reduces the shock and vibrations that are transmitted from the ram to the frame and from the anvil to the frame, which in turn permits the use of finer lubricants and less clearance and further inhibits damage from shock and vibration, and so on. Incidentally, the benefit of reduced clearance between the teeth and the grooves, aforesaid encourages finer finishes of and lighter lubricant between, the inclined mating and adjusting surfaces of the gib G and wedge 14, which in turn permits finer adjustment of the clearance between the teeth and grooves and enhanced utility and advantage thereof.

Referring now in passing to FIGS. 1, 2, 3 and 5, a hollow sleeve 30 is secured in the upper, forward part of the box C and welded between the forward edges of the side plates 1 and 2 and the back side of the front end member 4. This sleeve may be noticeably smaller than the sleeves S1 and S2. Its purpose is to provide a steady, long-wearing, well supported and protected bearing for the journals or shafts of cranks, levers and/or control linkage used to operate or throttle the hammer.

A word about the size and mass of the essential parts of a frame embodying my invention may aid in understanding its structure, function, mode of operation and results.

For example, a preferred form of one frame for use in a five thousand pound hammer weighs about 17,000 pounds and stands about 113 inches high from load bearing bottom of the base 5 to the upper surface of the head 9. The front frame member 4, the head 9 and the load-bearing part of the base are between about 9–10 inches thick of rolled or forged low carbon steel. The side plates and back member are about 2 inches thick and the reinforcing plates 6 and 7 A-D about 1½ inches thick and made of low carbon steel. The great sleeves S1 and S2 are about 6 inches outside diameter and approach the 8 inches width of the gib pocket E.

The frame embodying my invention lends itself to convenient manufacture and construction. Those skilled in the art of welding need no instruction in the particular and appropriate techniques of machining and finishing the surfaces between or upon which the welding rod material is deposited, nor the known preheating and controlled post-heating and cooling of the welded joints.

Figure 5:
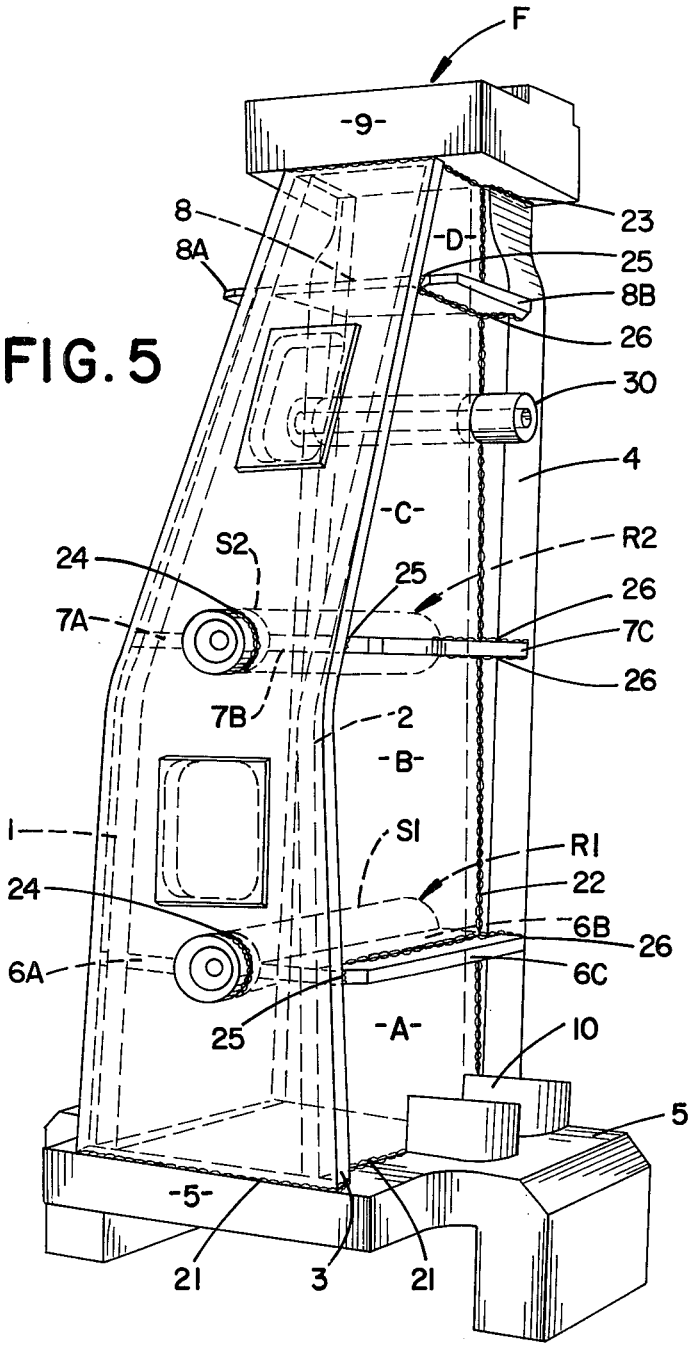
FIG. 5 is an isometric view of the said frame element embodying my invention taken from the near rear corner thereof.
Figure 7:
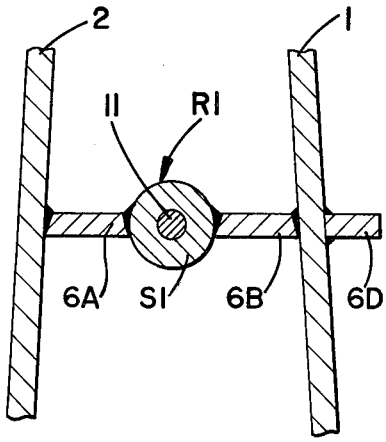
FIG. 7 is a fragmentary transverse sectional view taken along the lines 7—7 of FIG. 6 with the bolt added.

I prefer to begin the construction of my frame with the aid of appropriate jigs by making sub-assemblies of the inner parts of the reinforcing slabs R1 and R2 comprising the sleeves S1 fitted and welded to plates 6A and 6B, see FIGS. 5 and 7, and the sleeves S2 fitted and welded to plates 7A and 7B.

The next step conveniently comprises laying the front frame member 4, face downward on a level surface, more particularly on a surface or on supports that cause the back face of the member to be level, and then positioning the R1 and R2 assemblies, as well as the plate 8 reinforcement, upon the back side of the front member and normal thereto, and then welding the assemblies and plate to the back side of the front member. In this operation, the joints being welded are entirely accessible on the welder's right and left as they are presented to him so that "upper" and "lower" welds, as viewed when the frame is erect, are readily made on both sides of the assemblies R1 and R2 and the upper reinforcing plate 8. See, for example, the weld 24 between sleeve S1 and member 4 in FIGS. 6 and 10.

A next step is conveniently placing and securing the far side plate 1 with its straight front edge skived or chamfered and resting on the back of front member 4, standing normal thereto and engaging the far edges of the R1 and R2 assemblies and the far edge of upper plate 8. With the side plate so positioned and temporarily secured, it can be welded inside and out to the front member the whole length of its straight edge. Thereafter, the far edges of the assemblies R1 and R2, and plate 8 may be welded to the inside of the side plate. Again the joints are easily accessible to the welder, who can build his weld up from the front member to the uppermost ends of the assemblies and plate 8 as they stand rising from the prone front member.

In similar fashion, the near side plate 2 may be welded to the back of the front member and to the near edges of the R1 and R2 assemblies and the plate 8; the interior of the frame being open for easy access through the open back of the frame.

The next step may comprise the partial incorporation of the external gussets 6C and D, 7C and D and 8A and B by welding them to the exterior of the side plates and to the exposed outer part of the back face and adjacent side face of front member 4, all as at 26 shown in part in FIG. 3 and in part in FIG. 5. Showing welds between or adjacent parts depicted in dotted lines has been avoided.

All or part of the welding of any welded joint that will face upwardly when the frame is erected to stand vertically, or supported or suspended upside down vertically before final erection, may be deferred in whole or in part until the frame is disposed vertically, FIGS. 1, 2 and 3, or upside down, not shown, so that the welder will have the advantage of aiming his welding rod downwardly at and into the open "V", or similar place, which is to be filled and/or covered with the welded joint. This assumes that the parts to be welded ultimately in finished form are first sufficiently tacked or otherwise secured as to preclude injury or dislocation before all the intended welding is completed in the finally erected, or temporarily upside down frame. Similarly, after the joints or welded connections have been first tacked or otherwise secured preliminarily the frame may be laid on its side or turned or inclined as may be necessary or helpful to make a perfect or more perfect weld in the finished structure.

With the front member 4 still prone and the side plates 1 and 2 and reinforcing slabs R1 and R2 and plate 8 firmly secured together and to the front member in their not necessarily final welded state, the next step preferably comprises lowering the back end member 3 onto the rear edges of the side plates 1 and 2 and overlapping those edges as shown in FIGS. 2 and 5. Back end member 3 will have been bent as to fit the side plate and cut to length to equal or slightly exceed the planes of the ultimate upper and lower ends of the vertically extending frame members and elements. In the first instance, the back member can be secured into the frame structure by being welded to the exposed back ends of sleeves S1 and S2 with welds 24, FIGS. 3 and 5, and also where the back member contacts the rearward ends of gussets 6C and D, 7C and D and 8A and B, as by welds 25, FIGS. 2 and 5. After that the ends of the frame structure are squared off and/or skived or chamfered in preparation to being integrated by welding with the base 5 and head 10.

As suggested above, the open-ended unfinished frame may be welded most effectively to the head 9 by first placing and firmly supporting the head upside down with its then upwardly disposed surface level and prepared for being welded to the ultimate top ends of the frame plates and members 1, 2, 3 and 4. Then the frame is lifted, bottom-end-up and lowered to bear upon head in its ultimately desired relation and integrated therewith by welding as suggested at 23, FIGS. 1, 2, 3, 5 and 8. Should it be advisable to improve or complete the welds 23 as suggested in FIG. 8, for example, the frame may be returned to to its prone position with the front member 4 on the bottom.

The last major step will comprise lifting the frame with its open bottom squared off and prepared for welding and with the head attached, head-end-up, over and above the base 5 with the upper surface of base 5 level and prepared for welding to the bottom ends of plates 1 and 2 and front and back members 4 and 3. After the bottom of the frame has been lowered into its proper position on the base and held securely in that position it may then be welded conveniently all around the base as suggested at 21. As suggested in connection with welding the head onto the top, any or all the welds may be made, finished or improved, by laying the frame, wholly or partly assembled, horizontally on its front, back or side as may be necessary or expedient.

As best shown in FIGS. 3 and 5, the frame element has an upper portion beginning at about the half distance up from the base and rising above the monolithic reinforcing slab R2 and comprising boxes C and D with the back member 3 inclined from about the level of the slab R2 up to its juncture with head member 9 which also comprises part of the upper portion. The upper portion has a trapezoidal aspect as viewed in elevation in FIG. 3.

The lower portion rises from its incorporated base 5 between substantially parallel parts of the front and back members 4 and 3 up to about said half distance to slab R2 which it shares with the upper portion. The lower portion comprises boxes A and B and embraces and comprises the greater reinforcing slab R1.The lower portion has a substantially rectangular aspect in FIG. 3 and the greater depth between the front and back members 4 and 3. The slab R1 is relatively close to the height of the ram at the moment of impact with the work, and has the greater strength to resist and endure such impact. As shown best in FIGS. 2 and 5, the lower portion has a wide stance where the back member 3 has its maximum width and the side plates 1 and 2 are spaced most widely.

Bosses 10 may be welded to the base and side plates and front end member after the frame has been integrated with and welded to the base as suggested in most of the figures of the drawing without showing particular symbols for the welds.

As shown best in FIGS. 2 and 5, access and inspection holes 27 are provided in the back end plate 3 opening into boxes B and C. These holes permit inspection and some welding and repair work to be done inside the boxes. Closures 28, FIG. 5, for holes 27 are provided with stout means not shown, or welded, for secure attachment and necessary removal. I also prefer that these closures be lined on their inner faces with efficient, fire-proof, sound-proofing material to diminish the considerable noise that would otherwise tend to eminate from the boxes. If desired, the whole interior of any box, A-D, may be filled with fire-proof, sound-deadening, or sound-dampening material.

In the foregoing pages and accompanying drawings, I have illustrated and described specifically my best and most preferred form of my invention, as I presently understand it and, specifically the best way I know of to make a useful embodiment thereof. Improvements, modifications and equivalents will come to the minds of those skilled in the art as they come to understand, use and appreciate my invention without departing, however, from the essential teachings hereof and the principles invoked by my invention. Therefore, I do not want my patent to be restricted to the forms and practice herein described and illustrated specifically, nor in any manner inconsistent with the progress by which the art has been promoted by my invention.

I claim:

1. A drop hammer frame element comprising in combination an upright front member carrying the gib for guiding the ram, an upwardly extending back member spaced rearwardly from the front member, upwardly extending near and far side plates normal to said members and widely spaced from each other and engaging and spacing said front and back members and welded thereto, a base plate upon which the lower ends of said members and said side plates are supported and to which they are welded, a top plate supported by and welded to the upper ends of said members and side plates, all said plates and members forming an internally unreinforced frame element, rectangular horizontal internal reinforcing structures having vertical peripheral edges closely fitting substantially the whole interior perimeters of said element adjacent the said edges of said structures and welded to said side plates and members throughout substantially the whole peripheries of said structures at spaced elevations in said element between the lower and upper ends thereof, said reinforcing structures with said base and top plates, side plates and members making a plurality of six-sided box-like fabrications comprising a whole reinforced frame element, bolts adjacent and aligned horizontally with certain of said structures and connected operatively to said front and back members, and means for stressing said bolts in tension and prestressing said reinforcing structures in compression between said members.

2. The frame element of claim 1 with said head and base plates welded to the top and bottom ends respectively of said side plates and members, and said head and base plates and front member are between about four to six times as thick as said side plates.

3. The frame element of claim 1 with gussets aligned horizontally with said reinforcing structures and disposed outside said side plates and engaging said front and back members and securely welded to said plates and members and extending said structures outside said side plates.

4. The frame element of claim 3 with a plurality of said extended structures disposed in said frame element and spaced vertically and each comprising at least one horizontal side of a plurality of boxlike fabrications comprising said frame element.

5. The frame element of claim 1 with reinforcing sleeves embracing said bolts between said front and back members and welded at their ends to said members and integrated with said reinforcing structures to form monolithic slabs with lateral portions thereof horizontally disposed in alignment with the horizontal plane of the common axes of said bolts and sleeves between opposite sides of said sleeves and said side plates and securely welded to each thereof and joining said slabs with said sleeves to said side plates and said front and back members.

6. The frame of claim 5 wherein said slabs are prestressed with said sleeves.

7. The frame element of claim 5 wherein said front member has a gib pocket in which said gib is disposed and said slabs exceed the width of said gib.

8. The frame element of claim 5 with said upper and lower closures for the ends of said element and with a plurality of said slabs disposed in said element and spaced vertically from each other and forming with said lower closure a plurality of integrated boxlike fabrications comprising the lower part of said frame element adjacent said gib.

9. The frame element of claim 5 wherein said side plates converge from the bottom to the top of said frame element and said back member converges toward said front member as it approaches the top of said frame, and at least one said horizontal reinforcing structure is welded to said plates and members near the top of said frame.

10. The frame element of claim 9 with gussets disposed outside said side plates and between exposed portions of said front and back members and welded thereto at the levels of said reinforcing structures.

11. The frame element of claim 5 wherein said sleeve of said slab has its outside diameter approximately equal to the width of said gib.

12. The frame element of claim 5 wherein the said front and back members are parallel to each other for about half the distance up from the base, and the back member is bent toward the front member at about said half distance and inclined toward said front member in an inclined plane to its junction with said head member where the overall distance of said frame element from front to rear is about half the overall front to rear distance at said base, and one of said slabs is welded between said plates and members at about the level of said half distance where said back member is bent, and at least another of said slabs is welded to said plates and members, at a level between said one of said slabs and said base, said base and said slabs comprising a plurality of closed boxlike fabrications throughout substantially the lower part of said frame element where the front and back members are parallel and most widely spaced.

13. A pair of said frame elements described in claim 12 disposed in a drop hammer with their gibs juxtaposed for guid-opposite sides of the ram, a tie plate engaging both heads of said elements and both bases of said elements being secured to the anvil of said hammer.

14. The method of making a drop hammer frame weldment which, as used, in a drop hammer stands upright and has an upstanding back member disposed rearwardly in said frame, a vertically disposed relatively massive front member (compared with the upstanding back member and side plates) which carries the gib for the ram of the hammer on its front face, and upstanding side plates disposed between said members, comprising providing an internal reinforcing slab having front and rear ends and having a relatively massive mid-portion (compared with said side plates) extending between said ends, disposing said massive mid-portion in about the median vertical plane of said weldment, as used, and normal to said front member and spaced rearwardly of the gib part of said frame, welding said front end of said slab to the back of said front member, welding said side plates to the back of said front member, welding the sides of said slab to said side plates, welding said back member to said side plates, welding said rear end of said slab to said back member and making a functionally monolithic reinforcement throughout the whole cross section of said frame weldment adjacent the gib part thereof.

15. The method of claim 14 wherein said member and said back plate overlap said side plates with the steps of welding gussets to the outside of said side plates and to the front of the overlap of said back plate and to the rear of the overlap of said member.

16. The method of making a drop hammer frame element of metal constituents welded together, which frame has a massive head and base and a massive front member which normally stands vertically and has a smooth back side and a gib pocket in its front side, and has relatively thinner far and near side plates and a back member which rise and converge upwardly in the finished element and, with the front member, join said head and base, said massive parts being between about four to six times thicker than said side plates, and has reinforcing parts lying parallel with said head and base and extend horizontally in normal use and join said side plates and said front and back members to comprise a multiple box-like structure giving strength to said frame, comprising the steps of making weldments of at least certain of said reinforcing parts each with a hollow sleeve in the middle and plate parts welded to the sides of the sleeve, laying said front member prone in its front side, erecting said reinforcing weldments on the back side of said member and normal thereto in planes that will be horizontal when said member is vertical and with the axes of said sleeves lying in the median plane of said member, welding said weldments, so placed to the back side of said member, placing said far and near side plates on the back side of said member and normal thereto and contacting the opposite side edges of said reinforcing weldments, welding said side plates to said member and to said reinforcing weldments and making at least one five sided box opening rearwardly between said reinforcing weldments, placing said back member of the frame upon the exposed upwardly facing edges of said side plates and upon the upwardly facing edges of said plate parts which were welded to the sides of said sleeves with the rearward ends of said sleeves protruding through holes provided in the said back end member, and welding said back member to the protruding ends of said sleeves.

17. The method of claim 16 with the steps of bringing the exposed side plates and front and back members which are to support and be joined to said head into contact therewith at the intended place of juncture and welding the same to said head, and bringing the other end of said assembled plates and members into contact with said base and located as intended therewith, and welding the same to said base.

18. The method of claim 16 with the step of interposing and welding to said plates and said front member at least one plain reinforcing plate between one of said weldments and the smaller open end of the frame to which said head will be attached, placing gussets against the outside faces of said side plates in the planes respectfully of said reinforcing weldments and reinforcing plates with the ends of the gussets engaging both the front and back members, and welding said gussets thereto and to said side plates.

* * * * *